US008419932B2

(12) United States Patent
Silvester et al.

(10) Patent No.: US 8,419,932 B2
(45) Date of Patent: Apr. 16, 2013

(54) METHOD AND APPARATUS FOR SEPARATING COOKING OILS FROM SNACK FOOD PRODUCTS THROUGH A QUASI-CONTINUOUS CENTRIFUGE ACTION

(75) Inventors: John Silvester, Carina (AU); Leopoldo Zarate Andrade, Jalisco (MX)

(73) Assignee: Heat and Control Inc., Hayward, CA (US)

( * ) Notice: Subject to any disclaimer, the term of this patent is extended or adjusted under 35 U.S.C. 154(b) by 0 days.

(21) Appl. No.: 13/373,409

(22) Filed: Nov. 14, 2011

(65) Prior Publication Data

US 2012/0067794 A1 Mar. 22, 2012

Related U.S. Application Data

(62) Division of application No. 11/821,813, filed on Jun. 26, 2007, now Pat. No. 8,071,148.

(51) Int. Cl.

| | |
|---|---|
| ***B04B 1/00*** | (2006.01) |
| ***B04B 5/02*** | (2006.01) |
| ***B04B 11/02*** | (2006.01) |

(52) U.S. Cl.
USPC ..... 210/141; 210/360.1; 210/369; 210/380.1; 494/36; 494/49; 99/495

(58) Field of Classification Search ..... 210/141, 210/360.1, 369, 380.1; 494/36, 49; 99/495
See application file for complete search history.

(56) References Cited

U.S. PATENT DOCUMENTS 5,490,453 A * 2/1996 Mackay ..... 210/369
8,071,148 B2 * 12/2011 Silvester et al. ..... 426/478

* cited by examiner

*Primary Examiner* — David A Reifsnyder
(74) *Attorney, Agent, or Firm* — Law Offices of Donald N. MacIntosh

(57) ABSTRACT

A centrifuge operative in successive low speed and high speed modes serves to remove surface cooking oil from a continuous stream of fragile snack food products wherein the oil removal occurs in the high speed mode and products are discharged from the centrifuge with relatively low kinetic energy in the low speed mode.

4 Claims, 6 Drawing Sheets

METHOD AND APPARATUS FOR SEPARATING COOKING OILS FROM SNACK FOOD PRODUCTS THROUGH A QUASI-CONTINUOUS CENTRIFUGE ACTION

This application is a divisional application of U.S. patent application Ser. No. 11/821,813, filed Jun. 26, 2007, now U.S. Pat. No. 8,971,148, entitled "Method for Separating Cooking Oils From Snack Food Products Through a Quasi-Continuous Centrifuge Action", the entire contents of which is incorporated herein by this reference.

FIELD OF THE INVENTION

This invention relates to removal of excess surface oil from fried snack foods and similar products in a continuous manner, such products including pellet based snacks, potato chips and pork rinds. The salient characteristics of these products are their bulk, relatively fragile pieces consisting of discrete, often irregularly shaped pieces measuring typically 10 to 100 mm across.

BACKGROUND OF THE INVENTION AND THE PRIOR ART

By way of background, snack foods are commonly prepared or cooked in an hot oil bath and upon being removed from the cooking oil bath, a quantity of cooking oil is carried out adhering to the surfaces of the snack food products. In many cases the "carry-out" of the cooking oil is undesirable both from the standpoint of ultimate product taste as well as the cost of cooking oil which may often be more costly than the base snack product.

Conventionally these products have been de-oiled in batch type centrifuges. A batch centrifuge employs a generally cylindrical or conical basket rotatable about its vertical axis. In operation, the basket is filled while in the stationary condition and the product charge is retained by a discharge gate or valve in the bottom of the basket The basket is then rotated at a speed sufficient to produce a high centrifugal acceleration, typically on the order of between 30 and 60 g or even higher, at its periphery. The high speed rotation may be maintained for as little as 1 or 2 seconds or for 15 seconds or more depending on the nature of the product and the degree of de-oiling required. The rotation of the basket is then stopped and the discharge gate or valve is opened to discharge the batch. Finally, the gate or valve is dosed and the basket may be re-filled with the next batch of product to be de-oiled. Typically the batch type centrifuge must be integrated into a continuous process system wherein several disadvantages may be encountered.

One disadvantage is that a batching hopper or other means of surge accumulation must be provided to control the flow of product into the batch centrifuge. Another disadvantage is that frequently de-oiling by centrifuge is time critical being that the product must be spun as soon as practical after frying and before it begins to cool. It is understood that as the product cools the oil may become more viscous and/or be absorbed into the product, thereby inhibiting its removal by centrifuging. Obviously, the age difference between the oldest and newest product in a batch entering the centrifuge must be some time interval greater than the actual de-oiling time, i.e. the time spent under high centrifugal acceleration. Thus we see that the degree of de-oiling may vary within a batch depending on the age of each portion of the batch. Yet another disadvantage is the perception of many equipment customers that a batch process renders non-continuous an otherwise continuous process. Having regard to the variable time element described above, that perception is quite valid.

A centrifuge of the purely continuous type would appear to be a solution to the above disadvantages if it were capable of being successfully integrated into a snack food processing line for products of the type described above. In the prior art there many known types of continuous centrifuges. The milk clarifying centrifuge of U.S. Pat. No. 2,264,665, and those like it, served to separate liquids of different densities. U.S. Pat. Nos. 4,205,999 and 6,267,899 disclose apparatus and processes for separating liquids from solids or to recover liquids while discharging solid contaminants as waste. Also such apparatus may be adapted to the recovery of solids when those solids are sufficiently robust to survive the discharge process.

Prior art continuous centrifuges typically rotate at constant speed. Therefore both liquid and—of particular significance—solid fractions must exit the rotor in a state of high kinetic energy. A number of known centrifuges such as those disclosed in U.S. Pat. Nos. 4,462,570 and 6,521,120 discharge the solid components at a point of maximum rotor internal diameter and in these cases the kinetic energy will be very high. Fried snack food products of the types to be treated by the present invention are quite fragile. Upon discharge from one of the prior art centrifuges they would shatter or be severely damaged through impact with the centrifuge static shroud or outer wall. This issue was recognized in U.S. Pat. No. 6,267,899 wherein particular deflection structure was disclosed to ameliorate the impact forces upon the sugar crystals in the discharge step. A further limitation of such a centrifuge is the very short residence time for the solids in the rotor and the resulting de-oiling would be minimal. U.S. Pat. Nos. 5,160,441 and 6,712751 disclose conveying the solid fraction mechanically so as to discharge closer to the rotor axis wherein the solid factions would exit with reduced kinetic energy. In the interest of achieving a good throughput capacity, the discharge port of a practical rotor must be of a reasonable diameter but nevertheless the solids would still exit with a significant kinetic energy. And additionally, forcing the product to traverse the inner surface of the rotor under the influence of very high gravitational forces would be a source of product damage. We believe the problem of product damage upon discharge is solved through the cyclic rotational speed of a quasi-continuous centrifuge wherein the product is discharged only at very low rotational speeds and with very low kinetic energy.

SUMMARY OF THE INVENTION AND OBJECTS

In summary the invention resides in a method of removing an oil coating from the surfaces of a snack food product through use of a quasi-continuous centrifuge. The method steps include feeding a continuous stream of product from an oil cooker into the centrifuge whereupon the product is subjected to gravitational forces on the order of 30 or more g's. Such forces are maintained on the product for about 3 to 6 seconds and then deceleration to less than 1 g occurs, held there for about 1 to 4 seconds, and then accelerated to the 30 g plus realm, again deceleration, all for a sufficient action to strip surface oil from the products which are relatively fragile and to release the food product from the centrifuge at low kinetic energy.

The quasi-continuous centrifuge of the invention includes an exterior shroud mounted upon a frame and encircling a central drum having perforate walls. The drum is equipped with a plurality of internal downward projecting, frusto-conical chutes. A central drive shaft extends upwardly through the drum and carries a plurality of conically formed baffles mounted on the drive shaft. A drive motor is coupled to the shaft and is regulated by a controller to operate in a cycle so that the drum accelerates from 0 to about 550 rpm, more or less depending upon the diameter of the drum and desired g's, and holds there for about 3 to 6 seconds at which time product in the drum is subjected to g-forces on the order of 60 to 70 g's stripping oil from the product. The motor controller then acts to cause drum deceleration to a minimal g-force whereupon the food product and oil exit the drum at low kinetic energy. After a few seconds a subsequent cycle is commenced.

A general object of the invention is to provide in a food processing system employing an oil cooker a method and apparatus for removing the surface oil from the product through centrifuge action while minimally affecting the shape and texture of the product.

Another object of the invention is to provide a centrifuge for oil stripping action upon a relatively delicate food product that achieves minimal product damage by operating at cyclic rotational speeds so as to discharge the product at very low rotational speeds and with very low kinetic energy.

Still another object is to provide a multi-stage, quasi-continuous, oil stripping centrifuge that minimizes the time elapsed from the product exiting the fryer through completion of oil stripping.

In connection with the previous object, it is yet another object to initiate and complete the oil stripping centrifuge action in a manner that provides lithe opportunity for the fried food product to cool as contrasted to the manner typical of batch centrifuge action.

A further object is to provide a quasi-continuous centrifuge apparatus which in its simplicity of design and cyclic operation is adaptable to receive a continuous stream of hot oil coated food products, strip the surface oil and discharge the products relatively damage free and at low kinetic energy.

The above and additional objects and features of the invention will appear from the following specification in which a preferred embodiment has been set forth in detail and illustrated in the accompanying drawings.

DESCRIPTION OF THE PREFERRED EMBODIMENTS

Figure 1:
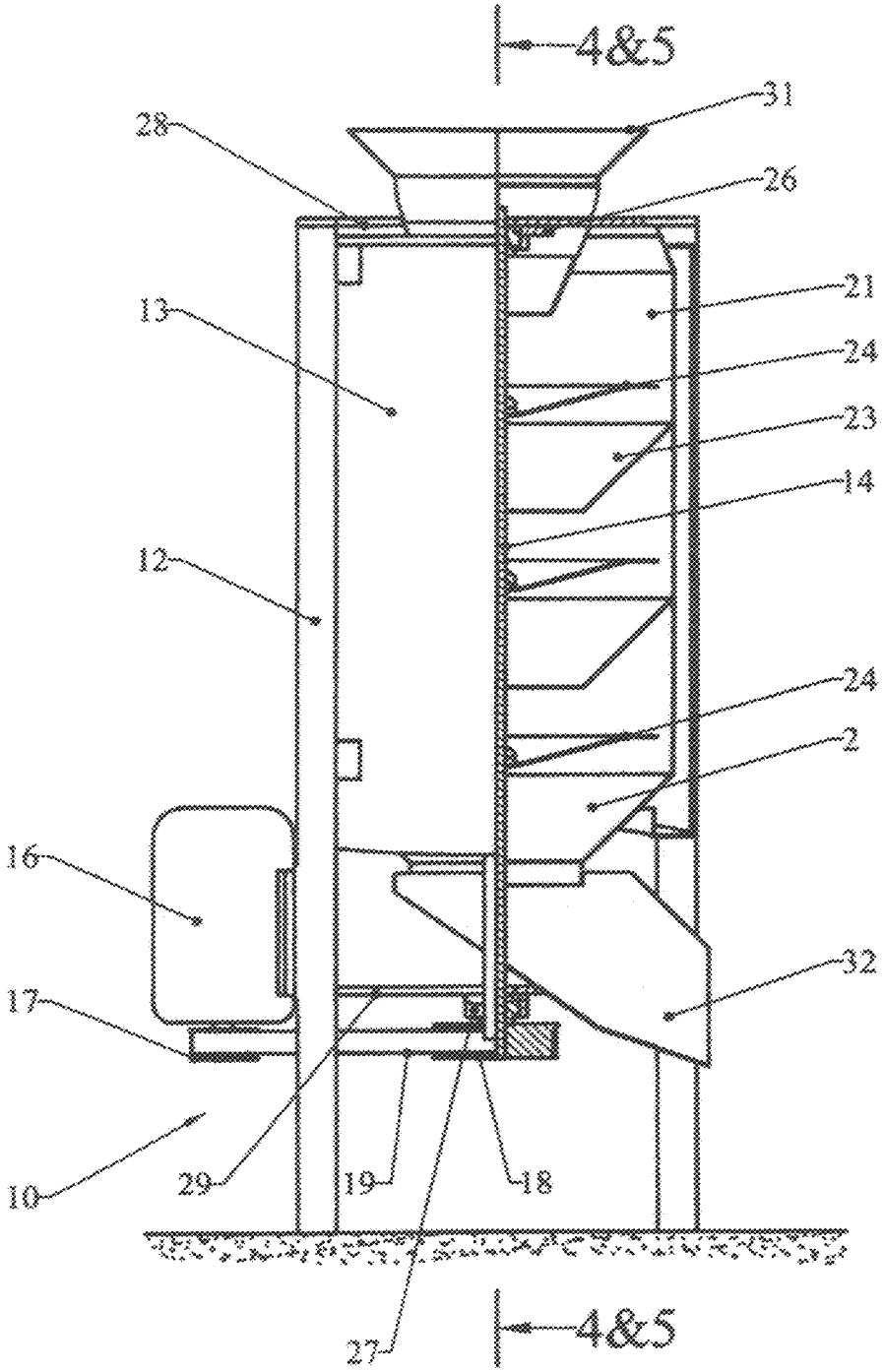
FIG. 1 is an elevation view of the centrifuge of one preferred form of the present invention, the view being partially in cross-section.
Figure 4:
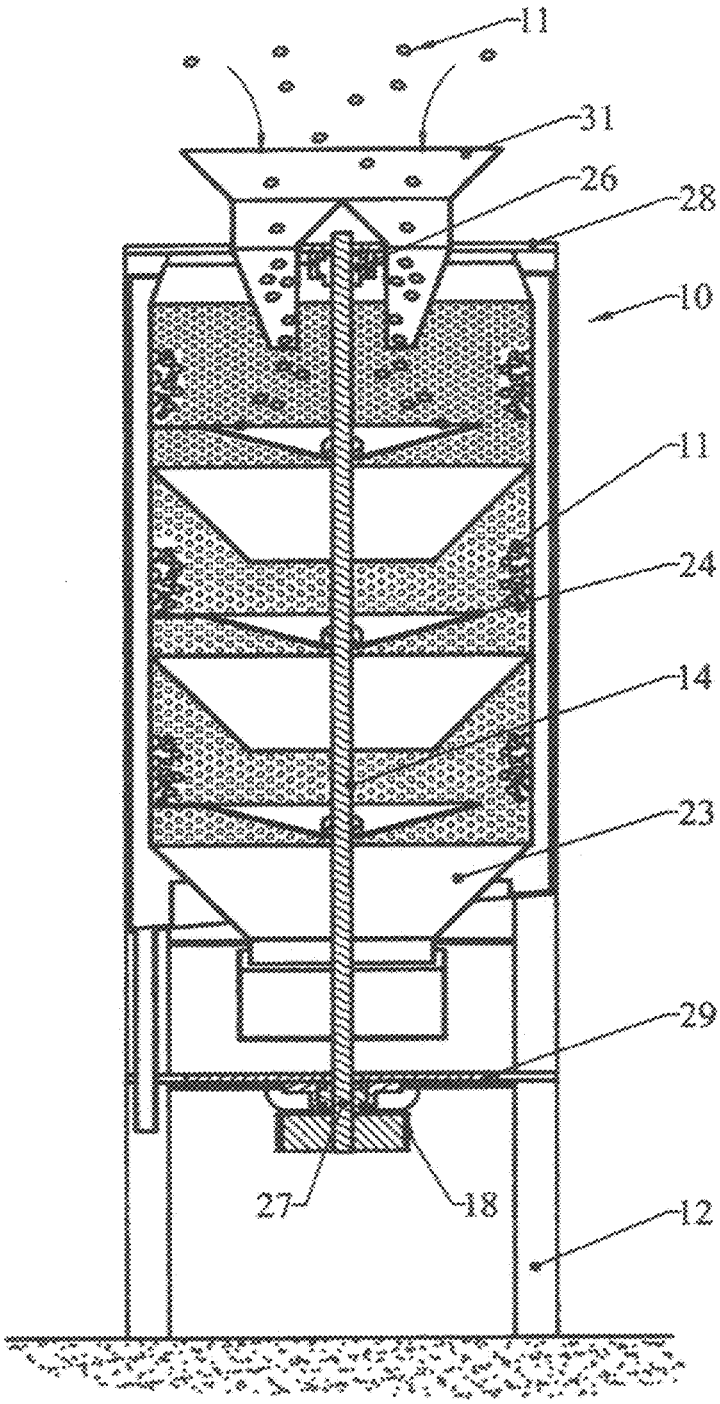
FIG. 4 is a sectional view taken in the direction of the arrows 4-4 of FIG. 1 illustrating the flow and distribution of the product while the centrifuge drum is rotating at high speed.

An improved centrifuge apparatus 10, in accordance with the method of the present invention, is equipped to remove surface oil from a delicate snack food product 11 upon its emergence from an oil fryer (not shown) and is depicted in the drawings, FIGS. 1 and 4 particularly. The apparatus 10 is a quasi-continuous centrifuge and includes a support frame 12, an external shroud 13, a vertically extending drive shaft 14 and shaft drive means comprising an electric motor 16 with drive pulleys 17-18 and timing belt 19. A programmable motor controller is also provided, either integral with the motor 16 or mounted remotely.

Figure 2:
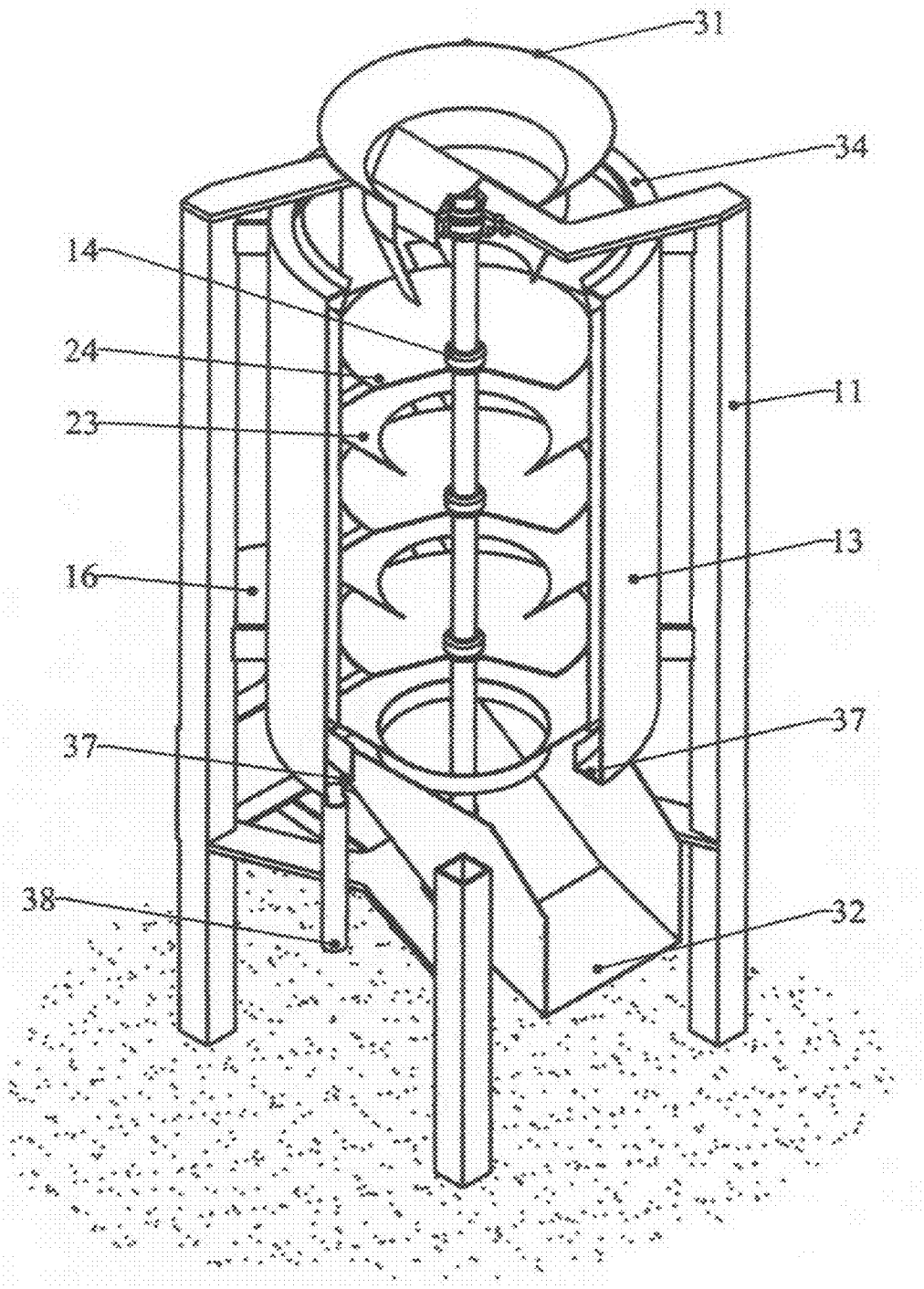
FIG. 2 is an isometric view of the centrifuge shown in FIG. 1 shown partially cut away to depict the major centrifuge components and the annular oil collection trough and oil discharge tube.
Figure 3:
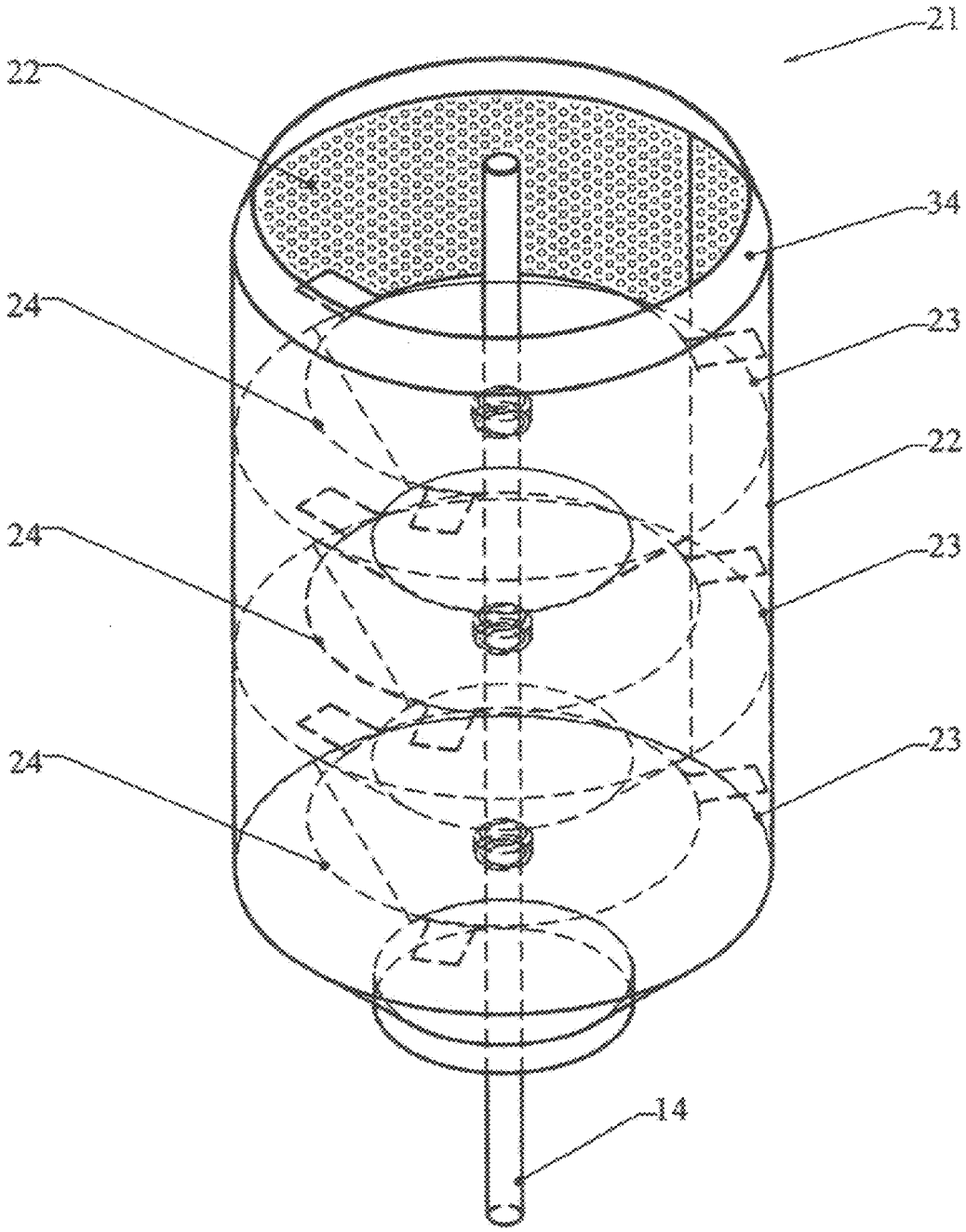
FIG. 3 is an isometric view on a larger scale showing the centrifuge drum with the perforate inner shell and associated conical baffles and conical chutes.

Referring to FIGS. 2 and 3, an internal drum 21 having perforate side walls 22 is mounted on the shaft 14 for rotation radially inwardly of the shroud 13. Three frusto-conically shaped product chutes 23 are mounted to the side walls 22 of the drum 21 concentric with the drive shaft 14. Mounted on the shaft 14 above each chute 23 is a conical baffle 24. Top 26 and bottom 27 bearing assemblies mounted on top and bottom horizontal frame members 28 and 29 respectively serve to rotatably support the drive shaft 14 with respect to the frame 12. Together each baffle 24 and chute 23 form a centrifuge operational stage and thus there is disclosed a three stage centrifuge.

As shown in FIGS. 1, 2 4 and 5, a product feed assembly 31 is mounted with respect to the top horizontal frame member 28 so as to receive a continuous supply of food product 11 from a source (not shown) and to disperse the same in downward streams onto the uppermost conical baffle 24 within the drum 21. A product discharge chute 32, as shown in FIGS. 1 and 2, is mounted on the frame so as to receive product descending from the lower most chutes 23 upon completion of the oil removal action of the centrifuge 10. A stiffening ring 33 is fixed to the drum 21 at the lower chute 23 as shown in FIG. 3. Similarly, an upper stiffening ring 34 is fixed to an upper portion of the drum 21.

Figure 5:
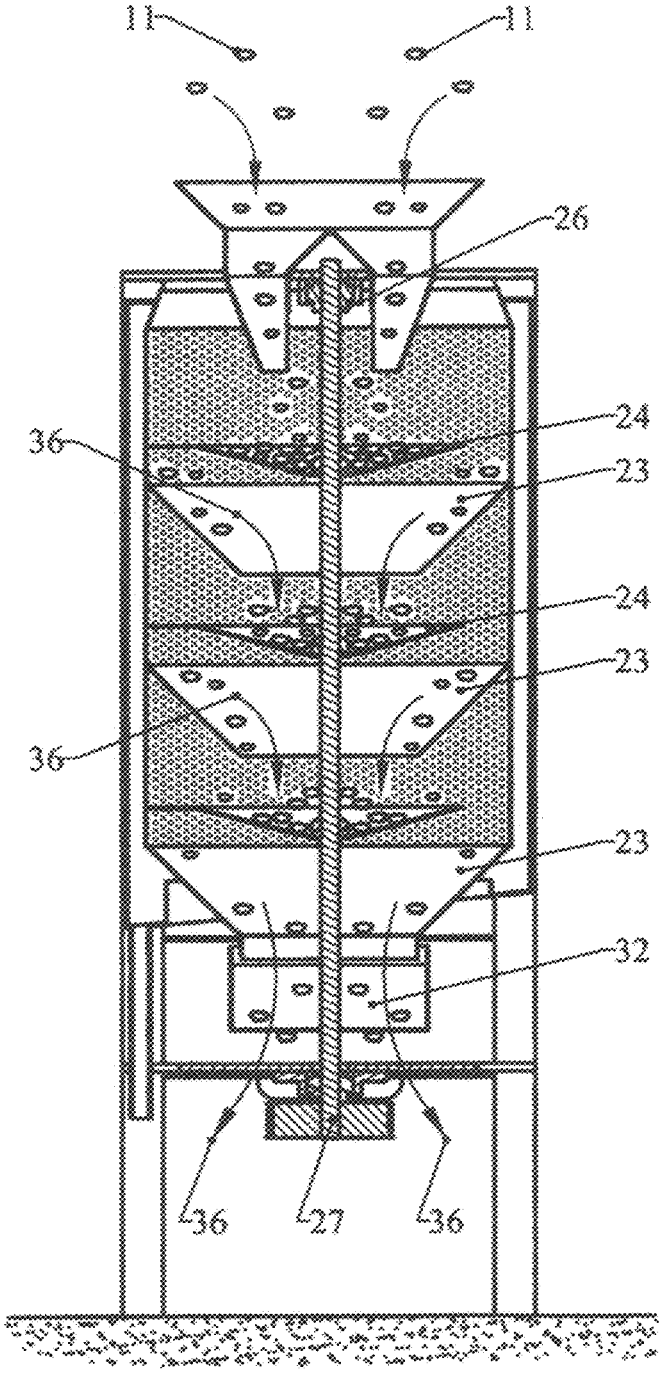
FIG. 5 is a view like FIG. 4 taken in the direction of the arrows 5-5 of FIG. 1 illustrating the flow and accumulation of product entering, traversing and exiting the centrifuge while the drum is stationary or rotating at low speed.

Referring specifically to FIGS. 4 and 5 where we see depicted two distinct operational modes of the centrifuge apparatus 10. FIG. 5 shows the disposition of the food products 11 when the rotational speed of the drum 21 is on the order of 0 to 30 rpm and the "g" loads approach 0. (As used herein the symbol "g" refers to gravity forces which are applied to the products 11 by operation of the centrifuge 10. These g forces are in the range of 0 ((normal)) to as much as 60 to 70 g's.) FIG. 4 shows the disposition of the food products 11 when the rotational speed of the drum 21 is on the order of 200 to 600 rpm and the g loads are in the higher range, 30 to 70 g's. Note that product 11 may be introduced into the infeed chute 31 continuously irrespective of the rotational speed of the drum 21 while product 11 may discharge form the discharge chute 32 when the drum is at low rotational speed. Thus it will be understood that as the drum 21 rotates in the low speed mode as shown in FIG. 5. food product 11 drops downwardly initially from the infeed chute 31 onto the uppermost conical baffle 24 to dwell there until the drum rotates in the acceleration mode where upon the product takes the positions as shown in FIG. 4. Upon drum rotation in the deceleration mode, the product cascades downwardly as indicated by the arrows 36 in FIG. 5. It will be further understood that as the drum rotation subjects the product 11 to high g forces, the surface cooking oil adhering to the product is stripped away and penetrates the drum wall perforations. In the low speed mode the oil so stripped moves downwardly along the inner walls of the shroud 13 and is received in a collection trough 37 and thence to a discharge tube 38. The oil thus recovered may be reused or not as the plant operator chooses. It has been observed that some snack products may be effectively de-oiled using accelerations as low as 30 g and may be damaged by higher g forces. As will be recognized by those skilled in the art, the g force is dependent upon both drum rotational speed and drum diameter. Therefore, we prefer as a practical range of useful drum diameters between about 400 mm and about 1200 mm. A preferred range of high g rotational speeds can be between about 200 and 600 rpm. The rotational speed range of 0-50 rpm is suitable for maintaining less than 1 g for that range of diameters.

Figure 6:
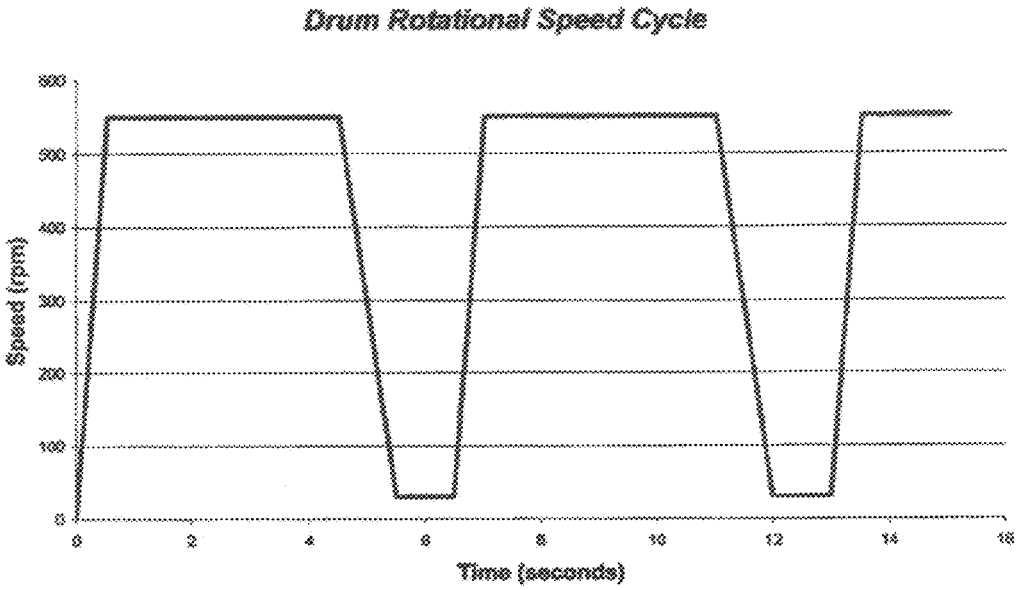
FIGS. 6 and 7 are respectively curves of time versus the centrifuge speed in rpm's and acceleration in g loads of the centrifuge operational cycles.
Figure 7:
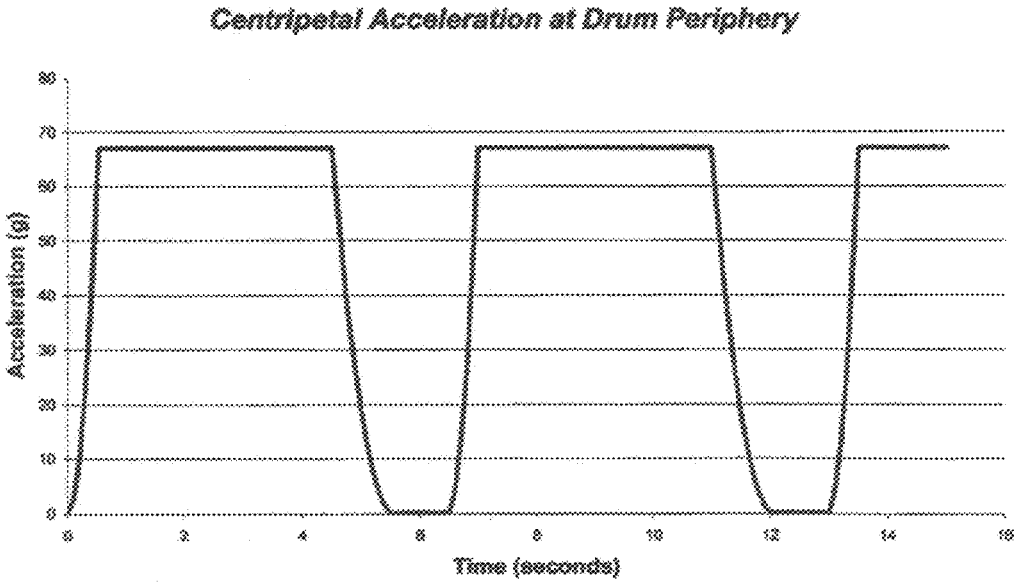

With reference to FIGS. 6 and 7 where typical drum speeds and g loads are charted, three examples of product treatment are given below from use of the centrifuge 10.

EXAMPLES

Example 1

Expanded pellets of approximately rectangular shape 50 mm by 40 mm by 4 mm thick and having irregular, wavy surface texture and shape were fed continuously at a rate of 60 kg/hr, directly from the fryer into a centrifuge having a 3-stage, 400 mm diameter drum. The centrifuge was running at 9.2 seconds cycle duration, as follows:

1) 0.2 seconds acceleration time;
2) 5 seconds at high speed of 550 rpm;
3) 1 second deceleration time;
4) 3 seconds at low speed of 30 rpm.

Samples of pellets taken before and after the centrifuge treatment were compared. Directly from the fryer, the pellets appeared wet, with a liberal coating of oil on the surface of each pellet, and the total oil content of the sample was measured at 14.4%. After centrifuging the pellets appeared noticeably dryer than before and the total oil content of the sample was measured at 9.6%.

Example 2

Expanded pellets in the shape of small donuts of approximately 22 mm outside diameter and 7 mm cross-sectional diameter were fed continuously at a rate of 220 kg/hr, directly from the fryer into a centrifuge having a 2-stage, 400 mm diameter drum. The centrifuge was running at 6.2 seconds cycle duration, as follows:

5) 0.2 seconds acceleration time;
6) 4 seconds at high speed of 550 rpm;
7) 1 second deceleration time;
8) 1 second at low speed of 30 rpm.

Samples of pellets taken before and after the centrifuge treatment were compared. Directly from the fryer, the pellets appeared wet, with a substantial quantity of oil retained in the spaces between pellets, and the total oil content of the sample was measured at 27.1%. After centrifuging the pellets appeared noticeably dryer than before and the total oil content of the sample was measured at 13.7%.

Example 3

Expanded pellets in the shape of sticks approximately 150 mm long and oval, approximately 6 mm by 8 mm, in cross section were fed continuously at a rate of 150 kg/hr, directly from the fryer into a centrifuge having a 2-stage, 400 mm diameter drum. The centrifuge was running at 6.2 seconds cycle duration, as follows:

9) 0.2 seconds acceleration time;
10) 4 seconds at high speed of 550 rpm;
11) 1 second deceleration time;
12) 1 second at low speed of 30 rpm.

Samples of pellets taken before and after the centrifuge treatment were compared. Directly from the fryer, the pellets appeared wet, with a substantial quantity of oil retained on the surfaces of the sticks, and the total oil content of the sample was measured at 20.5%. After centrifuging the pellets appeared noticeably dryer than before and the total oil content of the sample was measured at 13.1%. In all 3 examples, the degree of de-oiling was similar to that typically achieved in a conventional, batching centrifuge.

The embodiments disclosed herein together with the examples of use of the invention were chosen to best explain and describe the principles of the invention and its practical application to thereby enable any others skilled in the art to best utilize the invention in various embodiments and with various modifications as are suited to the particular use contemplated. It is intended that the scope of the invention is to be defined by the claims appended hereto.

What is claimed is:

1. A quasi-continuous centrifuge serving to remove surface oil coatings from snack food products upon their emergence from an oil cooker, comprising a upstanding frame, a shroud mounted upon said frame, a drive shaft, centrally mounted with respect to said shroud, shaft driving means operatively coupled to said shaft, a cylindrical drum having perforate wall structure permitting oil passage therethrough mounted radially inwardly of said shroud and constructed to be rotated by said drive shaft, a plurality of vertically spaced apart, conically formed baffles fixedly mounted upon said drive shaft with the baffle apexes projecting downwardly, a plurality of vertically spaced apart, frusto-conically formed internal chutes fixedly mounted upon said drum, each having a central opening permitting passage of product therethrough, a product input feed chute mounted with respect to said frame affording entry into the drum of product to be treated, a product discharge chute mounted with respect to said frame affording discharge from said drum of product treated in the centrifuge, and said shaft driving means including motor control means serving to permit rotation of said shaft, drum, baffles and chutes in an acceleration mode, a high speed running mode, a deceleration mode and a low speed dwell and product discharge mode so that oil coated product fed into the input feed chute and received upon one of said conical baffles, is thrust outwardly against said perforate drum wall and held there until the end of the high speed running mode wherein surface oil is stripped from the product which then cascades downwardly towards the product discharge chute and exits the centrifuge with low kinetic energy.

2. The quasi-continuous centrifuge of claim 1 wherein outwardly of said drum means are provided for collecting the oil removed from the product and conducting such oil from the centrifuge.

3. The quasi-continuous centrifuge of claim 1 wherein a slow speed product accumulation zone is provided by at least one of said conically formed baffles.

4. The quasi continuous centrifuge of claim 1 configured as a three stage centrifuge including for each stage a product accumulation zone defined by one of said conically formed baffles and one of said frusto-conically shaped internal chutes.

* * * * *